US005091100A

United States Patent [19]

Trivett

[11] Patent Number: 5,091,100

[45] Date of Patent: * Feb. 25, 1992

[54] FATTY TRIGLYCERIDE-IN-WATER SOLID FILM HIGH TEMPERATURE PRELUBE EMULSION FOR HOT ROLLED STEEL

[75] Inventor: Robert L. Trivett, Aurora, Ill.

[73] Assignee: Nalco Chemical Company, Naperville, Ill.

[ * ] Notice: The portion of the term of this patent subsequent to Jul. 11, 2006 has been disclaimed.

[21] Appl. No.: 569,802

[22] Filed: Aug. 20, 1990

[51] Int. Cl.[5] ..... C10M 173/02

[52] U.S. Cl. ..... 252/49.5; 252/51.5 R; 252/52 R; 252/56 R

[58] Field of Search ..... 252/49.3, 49.5, 51.5 R, 252/52 R, 56 R

[56] References Cited

U.S. PATENT DOCUMENTS 4,753,743 6/1988 Sech .

4,846,986 6/1989 Trivett .

4,855,104 12/1989 Sturwold ..... 252/54.6

*Primary Examiner*—Jacqueline Howard

*Attorney, Agent, or Firm*—John G. Premo; Robert A. Miller

[57] ABSTRACT

High temperature prelube emulsions, particularly advantageous for lubricating hot roll steel comprise a solid film prelube emulsion comprising a fatty acid triglyceride-in-water emulsion having the following formula:

| Ingredients | % by weight |
|---|---|
| A. $C_{14}$–$C_{22}$ fatty acid triglyceride | 5.0–10.0 |
| B. Water-in-oil emulsifier having an HLB number of at least 8. | 3.0–8.0 |
| C. Deionized Water | 65.0–85.0 |

8 Claims, No Drawings

FATTY TRIGLYCERIDE-IN-WATER SOLID FILM HIGH TEMPERATURE PRELUBE EMULSION FOR HOT ROLLED STEEL

TECHNICAL FIELD OF THE INVENTION

The present invention is in the technical field of metalworking operations, specifically stamping and drawing and the lubricants used therein, particularly solid film (dry film) prelubes for steel used in both the automotive, appliance and general manufacturing industries.

BACKGROUND OF THE INVENTION

Lubricants, especially solid film prelubes, are utilized in several metalworking operations. These metalworking operations can include stamping, drawing, forming, bending, rolling, cutting, grinding, punching, sawing, hobbing, reaming, spinning, extruding, trepanning, coining, swagging and the like. The present invention concerns the use of solid film (dry film) prelube emulsion lubricants for such type of metalworking operations, utilized on hot rolled steel used in the automotive, appliance and general manufacturing industries. In these three industries, the term, press working operation, is used to define all mechanical processes where sheet metal is formed into specific shapes by the use of mechanical presses. Such operations can further be categorized as stamping and drawing. The term, stamping, is further used to describe all forming operations where parts are formed from sheet metal such that there is no change in the gauge or thickness of the sheet metal. The term, drawing, is further arbitrarily divided into shallow drawing and deep drawing. Drawing defines all forming operations where there is a change or reduction in the gauge or thickness of the sheet metal. Shallow drawing can be defined as to the forming of a cup or shape no deeper than one-half its diameter with only small reductions in metal gauge or thickness. Deep drawing can be defined as to the forming of a cup or shape deeper than half its diameter with substantial reductions in metal thickness or gauge. Formed parts for the automotive, appliance and general manufacturing industries may be produced by one or a combination of these three fundamental fabrication metalworking operations.

Forming lubricants, especially solid film prelube emulsions, facilitate these operations by reducing the friction that occurs between the sheet metal being fabricated and the tooling employed for the forming operation. By reducing the coefficient of friction for the specific forming process, power requirements, tool wear and heat generated during forming operation are all diminished. Heat significantly can affect forming operations by changing metallurgical properties of sheet metal and tooling. It physically degrades these elements, causes their staining or oxidation and also creates physical and chemical changes in the lubricant affecting its performance. In addition, blocking or adhesion between the sheet metal and tooling is reduced or eliminated during the forming operation, transit and storage of the formed parts.

In operations involving automotive, appliance and general manufacturing applications the prevention of blocking or adhesion between the sheet metal and tooling is of extreme importance. In addition, the use of specific metalworking forming lubricants such as solid film prelube emulsions significantly can reduce or eliminate the production of scrap parts (formed parts rejected due to physical damage) which may result from the failure of some forming lubricants. One major purpose of the presented invention is to provide improved lubrication to hot rolled steel forming operations. Forming lubricants, especially solid film prelube emulsions, must be capable of functioning on a variety of sheet metal substrates including cold rolled steel, hot dip galvanized, electrogalvanized, galvaneal, galvalume and aluminum.

All basic steels are formed by the basic oxygen process. After the initial chemical process forming the molten steel, the molten steel is either poured to form ingots or continuously cast slabs. Ingots are then converted to slabs in a primary mill (known as a slabber or bloomer). Slabs are then processed via hot rolling:

a. slab is reheated to approximately 2500° F. in a reheat furnace,
b. reduced to an intermediate gauge or thickness via a series of roughing mills,
c. then rolled to a final hot band gauge via a series of finishing mills. Finally the steel is coiled. All cold rolled, galvanized and hot rolled steel sold as pickled and oiled go on to pickling and further processing stages.

Hot rolled steel, also known as hot rolled strip or plate steel, undergoes no further processing. These types of steel are mainly used in applications requiring structural strength and are in thicknesses of 0.060 inch and greater. A large quantity of hot rolled steel is used in deep drawing to produce compressor housings for refrigeration systems used in appliance systems. General manufacturing parts produced include gas cylinders used to store and transport liquefied petroleum gases and acetylene. Such automotive parts formed include vehicle road wheels, axle cases and a variety of chassis sidemembers. The typical mechanical properties of the three quality grades of hot rolled steel are summarized below:

a. Commercial quality (good flatness used in shallow draws): yield strength of 38,000 psi, tensile strength of 52,000 psi, 30 percent elongation for two inches and RB hardness of 55.
b. Drawing quality (deep drawn parts): yield strength of 35,000 psi, tensile strength of 50,000 psi, 36 percent elongation for two inches and RB hardness of 50.
c. Quality Special Killed (age-hardened): same properties as those of drawing quality except elongation is 40%.

Some hot rolled steel will be used as simply hot rolled sheet and strip while a portion sold as hot rolled pickled and oiled exposes the hot rolled strip to an acid pickling medium (150° F.–180° F.) to remove scale, rinsed with water, then air dried and oiled.

In several metalworking processes, sheet steel coils are cut into pieces known as blanks which are then stamped or drawn to produce the desired finished parts such as those described earlier. Forming lubricants, including solid film prelube emulsions, are often required to provide corrosion protection against a wide range of varying environmental conditions that steel coils can encounter during storage and transportation. Furthermore, when the steel coil is cut into blanks, the forming lubricant must also be required to provide corrosion protection while blanks are transported to other processing facilities or while awaiting further fabrication between operations.

In the recent past, metalworking forming processes were often tedious and complicated, involving a variety of different product types. Often, steel coils would arrive at a processing site, such as a stamping plant, coated with a rust preventative oil. Between the steps of blanking and the actual forming operation, the rust preventative oil would be removed by a cleaning operation (alkaline cleaner, solvent cleaner or blank wash oil). Some type of forming lubricant would then be applied to the sheet metal immediately prior to the stamping or drawing operation. Such lubricants were hydrocarbon oil-based compositions applied as is or emulsified in water. In the last decade, this tedious process of using separate rust preventative oils and drawing lubricants has been replaced in many operations by the use of a single composition known as a prelube. Whether hydrocarbon oil based or solid film, prelubes are applied at the steel mill during either temper rolling or inspection, as rust preventative oils are prior to shipping. Thus no modifications are necessary within the steel mill to physical equipment or processes to use prelubes. Such prelube compositions are thus not intentionally removed from the sheet metal until after the blanking and forming operations. Thus, the use of such prelube compositions eliminates the cumbersome process of applying and removing the combination of rust preventative oils and forming lubricants before further working with only one composition (whether oil-based or solid film). Prelubes thus must function as both a corrosion preventative and forming lubricant.

One of the most important properties of a prelube composition besides lubrication and corrosion protection is cleanability or removability. The performance benefits offered by solid film prelube emulsion compositions, would be nullified if drastic measures were necessary to clean them from the surfaces to which they have been applied. In order to prevent interference with all future processing operations after forming, it is necessary for all traces of the prelube composition to be totally removed from the metal surface of the formed part. In the automotive, appliance and general manufacturing industries, powdered or aqueous alkaline cleaners are the normal chemical compositions utilized for removing prelube and other lubricant compositions. These alkaline cleaners are composed of various mixtures of nonionic biodegradable surfactants, amines and different types of inorganic alkalis. Such compositions are water soluble at the recommended dilutions (concentrations of one to four ounces per gallon) and are strongly alkaline in nature (pH of 10.0–12.0). They are designed to effectively remove all traces of processing lubricants and fluids from the wide variety of metal substrates described earlier including hot rolled steel. Formed parts are cleaned in a variety of system types utilizing spray (15–35 psi), immersion and combinations of both types. Formed parts are exposed to cleaner solutions for varying time increments, ranging from 30 seconds to 3.0 minutes for spray systems and 1.0 to 5.0 minutes for immersion systems. Such cleaner compositions effectively operate over a wide temperature range. Appliance industry parts are cleaned over a wide temperature range from 120° F. to 180° F. In the automotive industry, most formed parts are being cleaned at temperatures from 105° F. to 135° F. Parts formed in general manufacturing industries are cleaned at temperatures over a wide range from 120° F. to 190° F. Many prelube compositions, especially hydrocarbon oil based systems, contain chemical additives that cannot be easily removed with such alkaline cleaners, thereby having serious and detrimental effects on all future processing operations and narrowly limiting the use of such compositions.

An important advantage of the presented invention is the improved cleanability of the lubricant from hot rolled steel substrates versus the other prelubes used on such substrate including hydrocarbon oil based and dry film lubricant compositions. This cleanability advantage also extends to all of the types of steel substrates described earlier.

Steel coils, including those composed of hot rolled steel, coated with prelube compositions can be stored for indefinite periods of time before being stamped or drawn into parts. Many chemical constituents of such prelube compositions can oxidize to varying degrees during these storage periods. Oxidation byproducts from hydrocarbon oil components can adversely affect metal surfaces causing staining, discoloration and etching or pitting of the outer molecular layers of the steel strip. Automotive, appliance and general manufacturing industries require prelube compositions that will protect all metal substrates against conditions of oxidation and will not cause contact staining during storage periods.

Prelubes must be compatible with other processing chemicals and operations following forming operations. Many parts formed in the automotive, appliance and general manufacturing industries often have severe bends or angles formed during fabrication operations. These bends and angles can create flanges, seams or other tight radii where prelube compositions can become entrapped. Even with normal exposure to alkaline cleaners, trace amounts of prelube can remain within these intricate areas out of reach. Thus, although the prelube compositions may be effectively removed from exposed part surfaces, trace amounts of prelube can be volatilized, released and contaminate subsequent processing operations. This potential situation necessitates that such prelube compositions, especially solid film prelube compositions, be compatible with cathodic electrocoat paint primers and adhesives use to bond structural components together as well as any type of post welding operations. Trace levels of contamination cannot interfere with the electrocoat process of deposition of paint primers where resulting craters could lead to potential paint finish problems and corrosion. Likewise, contamination cannot affect the wetting or bonding strength of structural adhesives. Many formed parts are often welded into sub component parts before final assembly and cleaning so the welding process or welds themselves cannot be affected in any manner. Thus prelube compositions, including solid film prelube emulsions, should be compatible with such processing compositions and operations.

A vast majority of prelubes used commercially in automotive, appliance and general manufacturing industries are liquid compositions composed of petroleum hydrocarbon oils and additives. Because of their fluid nature, such compositions tend to become unevenly distributed within coated steel coils on the metal surfaces, collecting or pooling due to capillary action or gravity. The occurrence of this condition can have a drastic effect on prelube performance as film uniformity on the sheet metal strip is critical for superior corrosion protection and successful forming. Thus all of the industries discussed earlier demand a prelube that provides the desirable film uniformity thereby insuring adequate corrosion protection and lubrication required by forming operations, especially severe drawing operations. It is an important performance benefit of the present invention to provide the proper film coverage; eg., uniformity, homogenous and consistent film morphology and structure on hot rolled steel substrates.

Often, prelube compositions are applied at coverage rates up to 1000–2000 mg/ft$^2$ in some industries to provide the required performance. The automotive, appliance and general manufacturing industries desire prelube compositions that can offer effective performance at lower coating weights thereby improving overall cost efficiency of the forming operation. It is a desired advantage of the present invention to provide effective performance on hot rolled steel substrates at lower coating weights between 100 and 300 mg/ft$^2$, which substantially improves forming lubricant cost performance.

All prelube compositions must lend themselves to improving housekeeping and cleanliness conditions at the steel mill and at the manufacturing plant. Often, hydrocarbon oil based lubricants and some dry film prelubes can leak onto machine and work surfaces or volatilize into the atmosphere creating hazardous work environments. Compositions can often create irritation or dermatitis among employees exposed to the compositions on a daily basis. Sometimes, compositions can contaminate floor trenches around forming presses, thereby often reaching waste treatment streams. It is a prime feature of the present invention for hot rolled steel to be nonhazardous, worker friendly and safe to use on a continual basis.

Finally, a prelube composition must be compatible with the current waste treatment processes and chemicals. Prelube compositions entering those streams must have minimal to no effect on those streams as well as being chemically capable of being waste treatable. It is another purpose of the presented invention to be compatible with existing waste treatment schemes by both having lower quantities (because of lower coating weights) entering the stream and being treatable by waste treating processes.

It is another object of the present invention to provide a metalworking lubricant, and more specifically, a solid film high temperature prelube emulsion for hot rolled steel that provides all of the foregoing desirable characteristics, and advantages especially superior corrosion protection and lubrication as well as compatibility with all processing and forming operations. It is a further object of the present invention to provide a method of coating and lubricating a variety of metal substrates including hot rolled steel that provides all of the foregoing desired advantages. These and other objects of the invention are described below.

THE INVENTION

The invention provides a solid film prelube emulsion comprising a fatty acid triglyceride-in-water emulsion having the following formula:

| Ingredients | % by weight |
|---|---|
| A. $C_{14}$–$C_{22}$ fatty acid triglyceride | 5.0–10.0 |
| B. Water-In-Oil Emulsifier having an HLB number of at least 8 | 3.0–8.0 |
| C. Deionized Water | 65.0–85.0 |

The emulsion of the presented invention is considered a high temperature prelube emulsion in that the melting point of the dried emulsion coating upon evaporation of the aqueous carrier is between 170° F. and 180° F. Lubricant can easily be applied as is to a metal substrate via a roll coater system by one of two methods:

a. lubricant is warmed and applied to a warm metal substrate, b. lubricant is applied at ambient temperature to a metal substrate at ambient temperature. Depending upon the choice of application, a series of warm ovens may be necessary to evaporate the aqueous carrier, reflow the coating following drying or both. Under normal application conditions, the water readily evaporates leaving a dry, solid film prelube coating on the metal substrate.

The lubricant includes as preferred, yet optional ingredients the following:

| Ingredients | % by weight |
|---|---|
| D. Boundry Lubricant and Film Plasticizer | 0.1–3.0 |
| E. Antioxidant | 0.1–2.0 |
| F. Ethylene Polymer | 0.1–3.0 |
| G. Corrosion Inhibitor | 1.0–5.0 |
| H. Microbiocide | 0.5–1.0 |
| I. High Temperature Surfactant | 0.1–2.0 |

THE FATTY TRIGLYCERIDE

The active lubricant in the fatty triglyceride-in-water emulsion is the fatty triglyceride. This ester contains in the fatty acid position from 14 to 22 carbon atoms. It may contain branch substituents such as —OH. The preferred triglycerides are saturated. They may be mixed triglycerides of the types commonly found in animal fats and vegetable oils.

In preferred embodiments, the substantially saturated triglyceride is formed from the hydrogenation of castor oil, more specifically the hydrogenation of ricinoleic acid (12-hydroxyoleic) which comprises 89.7 percent by weight of castor oil. The substantially saturated ester has a melting point of from 186° F. to 191° F.

In more preferred embodiments, the substantially saturated ester is a triglyceride of 12-hydroxystearic acid, resulting from the hydrogenation of ricinoleic acid. Ricinoleic acid is an 18-carbon acid with a double bond in the 9–10 position and a hydroxyl group on the twelfth carbon atom. Saturation of such double bonds converts each hydroxyoleic chain to hydroxystearic. A very preferred embodiment is the triglyceride, substantially saturated triglyceride derived from ricinoleic acid is a composition having acid number of 2.2, a composition having a saponification number of 180, iodine value of 2.2 and a melting point of 188.5° F.

THE EMULSIFIER

An emulsifier having an HLB of from 8 to 18 are preferred for enabling the emulsions of this invention. Preferably, the emulsifier will have an HLB of from 8 to 12. The most preferred emulsifier is the ester reaction product formed from double-pressed stearic acid and 2-amino-2-methyl-1-propanol. It is noteworthy that the ester reaction product formed from such reaction also functions as both a corrosion inhibitor and source of reserve alkalinity in both the triglyceride-in-water emulsion and in the dried film. The excess stearic acid remaining from the reaction functions also as a corrosion inhibitor and boundary lubricant in the dried film. In preferred embodiments, the stearic acid is double pressed stearic acid with a molecular weight of 285, an approximate acid value of 210 with accompanying saponification value of 211 and liter value of 120° F. In preferred embodiments the 2-amino-2-methyl-1-propanol has a specific gravity of 0.942, neutralization value of 95 and flash point of 182° F. (TCC).

THE BOUNDRY LUBRICANT—FILM PLASTICIZER

The tridecyl stearate boundary lubricant-film plasticizer preferably is the ester reaction product formed from tridecyl alcohol and stearic acid. More specifically the tridecyl stearate is the reaction product formed from reaction between stearic acid which has a molecular weight of 285 and 1-tridecanol which has a molecular weight of 200 and a specific gravity of 0.8223. More specifically, the tridecyl stearate is one having an acid value of 1.5, saponification value between 117 and 126 and a specific gravity of 0:86 at 77° F.

THE ANTIOXIDANT

The lubricant may also contain from 0.1 to 2.0 weight percent of a hindered phenol antioxidant, preferably 2,6-di-tertiary-butyl-para-cresol with a melt point of 147° F.

THE ETHYLENE POLYMER

The ethylene homopolymer, and more preferably a copolymer of ethylene and acrylic acid which promotes uniform wetting of the triglyceride-in-water emulsion and promotes adhesion of the dried coating to the metal substrate. The ethylene-acrylic acid copolymer is a composition having a melting point from 190° F. to 200° F., an acid value of about 120 with a hardness of from 9 to 22 dmm at 77° F. with a viscosity of 610 centipoise at 285° F.

THE CORROSION INHIBITOR

The lubricant contains from 1.0 to 5.0 weight percent of a ethyl hydroxymethyl oleyl oxazoline as a corrosion inhibitor. More specifically, the preferred composition is the oleyl oxazoline (2-(8-heptadecenyl)-4-ethyl-4-hydroxy ethyl oxazoline) with a specific gravity of 0.93 at 77° F., a viscosity of 155 centipoise at 77° F. and a surface tension of 40 dynes per centimeter for a 0.001% aqueous solution.

THE MICROBIOCIDE

The preferred antimicrobial agent present from 0.05 to 1.0 weight percent is 1-(3-chloroallyl)-3,5,7-triazo-1-1 azoniaadamantane chloride.

THE HIGH TEMPERATURE SURFACTANT

The ethoxylated alkyl phenol surfactant which improves high temperature wetting and coverage of the triglyceride-in-water emulsion more specifically is the ethoxylated nonyl phenol with the molecular formula of $(C_2H_4O)_9C_{15}H_{24}O$ with a molecular weight of 616, a specific gravity of 1.06 at 77° F. and most importantly, for product performance, a cloud point between 158° F. and 172° F. for a one percent aqueous solution. This is also nonyl phenol reacted with 9 moles of ethylene oxide.

The most preferred lubricant composition of this invention contains:

a. from 3.0 to 8.0 and preferably 3.0 to 5.0 weight percent of a triglyceride-in-water emulsifier composition having an HLB of at least 8, preferably 8 to 18 and most preferably 8 to 12 which is the ester reaction product between stearic acid and 2-amino-2-methyl-1-propanol;
b. from 65.0 to 85.0 weight percent water;
c. at least one substantially saturated ester formed from the hydrogenation of ricinoleic acid, more specifically the triglyceride of 12-hydroxystearic acid boundary lubricant present between 5.0 and 10.0 weight percent;
d. an effective plasticizing amount, comprising from 0.1 to 3.0 weight percent of the reaction product between stearic acid and tridecyl alcohol, more specifically, the boundary lubricant tridecyl stearate;
e. from 0.1 to 2.0 weight percent of hindered phenol antioxidant;
f. from 0.1 to 3.0 weight percent of an ethylene-acrylic acid copolymer wetting agent and adhesion promoter;
g. from 1.0 to 5.0 weight percent of ethyl hydroxymethyl oleyl oxazoline corrosion inhibitor.
h. from 0.05 to 1.0 weight percent of a chloride antimicrobial agent,
i. from 0.1 to 2.0 weight percent of an exthoxylated nonyl phenol which improves high temperature application of the triglyceride-in-water emulsion.

These and other preferred embodiments are described in more detail below.

USE OF THE LUBRICANT

The lubricant, according to the present invention is a triglyceride-in-water emulsion, a solid film prelube emulsion type of coating particularly useful in metal-working operations and particularly advantageous for stamping and drawing operations on hot rolled steel for applications in the automotive, appliance and general manufacturing industries. The particular coating is characterized as a solid dry film prelube film because only a solid film is left upon evaporation of the aqueous carrier.

The lubricant, according to the present invention, as described in more detail below is generally one that is liquid at ambient room temperature and applied to the hot rolled steel or other metal substrates at elevated temperatures in a triglyceride-in-water emulsion form. Evaporation of the water from this triglyceride-in-water emulsion form results in a uniform and homogenous, dry solid lubricant coating on the metal substrate.

As mentioned earlier, the properties of corrosion prevention and forming lubrication capabilities of the solid film prelube emulsion invention for hot rolled steel are both highly dependent to a significant degree upon the uniformity of lubricant coating film on the metal substrate. Performance properties of prelube compositions, especially solid film prelubes, are greatly enhanced and advanced by the presence of a uniform and homogenous coating on the metal substrate until such time during which the coating is removed by some form of cleaning operation. The lubricant, according to the present invention, offers this important performance advantage in that it is a solid, consistent and continuous coating which is retained on the metal substrate until such time removability is called for.

The lubricant of the present invention is particularly useful as a solid film prelube coating for applications on hot rolled steel and other metal substrates in the automotive, appliance and general manufacturing industries. Its performance properties however, also would make it an excellent lubricant selection for prelube operations outside such applications and within such applications may also be applied to all work elements, tooling such as dies, the like and metal substrates.

The lubricant, according to the present invention, may successfully be coated onto a variety of metal substrates including hot rolled steel by passing the substrate through a liquid bath at elevated temperatures, applying the lubricant by rollcoating, removing the excess by squeegy and then evaporating the water from the coating film. Such lubricant may also be applied in any manner suitable for a viscous liquid including brushing, dip-coating or electrostatic spray.

COATING THE LUBRICANT

For commercial applications, the solid film prelube composition may be applied via an electrostatic spray, by dipping the metal through a bath containing the composition or by running the metal through a rollcoater. A series of moving coating rolls will apply the composition to a moving metal strip (from coating pans containing the composition) as the strip runs between the rolls. A variety of coating variables including metal strip speed, speed of the coating rolls, size, number and composition of the rolls, composition viscosity and dilution, pressure of the rolls on the metal strip, gap sizes between the metal strip and coating rolls and temperature of the metal strip and solid film prelube composition all will determine the final coating weights applied.

The preferred method of application to hot roll steel is applying the solid film prelube composition via a rollcoater to the hot roll steel strip at the exit end of a hot roll steel pickling station (acidic cleaning station). Composition can be diluted with water to a specific concentration and warmed to an application temperature of 140°-180° F. Hot roll steel strip can efficiently be coated at line speeds from a minimum of 25 ft./minute to a maximum of 125 ft./minute with 60–70 ft./minute being the optimum. Hot roll steel strip entering the rollcoater should have a peak metal temperature ranging from a minimum of 130° F. to a maximum of 170° F. As the solid film prelube composition was applied to hot roll steel strip under these coating variables, water will instantaneously volatilize from the steel surface, cooling the coating and causing it to set. The application of an ambient air temperature quench (air flow pattern) across the strip immediately after the rollcoater and prior to the coiling station may be necessary to cool the coil down to ambient temperature conditions before rewinding of the coil. These variables can be combined to effectively coat a hot roll steel strip with the solid film prelube composition of the invention from a minimum coating weight of 50 mg/ft$^2$ to a maximum of 500 mg/ft$^2$.

Despite the variety of coating methods, the solid dry film high temperature prelube emulsion for hot roll steel composition according to the present invention dries to a smooth and clear coating (which is hard, pliable, nonblocking, non hygroscopic and odorless) on all types of steel with excellent surface adhesion and wetting properties providing a consistent and homogeneous film coating on the metal substrate.

The advantages and utility of the lubricant, according to the present invention, are further described in the following listed examples.

EXAMPLE 1

A water-based, solid dry film, high temperature prelube emulsion for hot roll steel, according to the present invention, was prepared as follows:

Two blending vessels equipped with mechanical means of heating and stirring were used. Both vessels were well insulated to allow for both uniform heating and cooling.

The following ingredients were added and mixed in the first vessel: 9.00 parts by weight of a hydrogenated castor ester, commercially available under Union Camp Chemicals trademark CENWAX G; 0.55 parts by weight of a tridecyl stearate, commercially available under Union Camp Chemicals trademark UNIFLEX 188; 0.10 parts by weight of a hindered phenol antioxidant, commercially available under the Shell Oil Company trademark IONOL; 0.30 parts by weight of an ethylene-acrylic acid copolymer, commercially available under the Allied Corporation trademark A-C 5120; 2.85 parts by weight of an oleyl oxazoline (2-(8-Heptadecenyl)-4-ethyl-4-Hydroxy ethyl oxazoline), commercially available under the Angus Chemical Company trademark ALKATERGE E and 4.30 parts by weight of double pressed stearic acid, commercially available under the registered trademark of CENTURY 1220, belonging to Union Camp chemicals. The mixed blend was heated to 190° F. A homogeneous and uniform liquid was produced.

In the second vessel, 53.55 parts by weight of deionized water was added and stirred at constant speed and heated to 190° F. The water temperature was then maintained with constant stirring at 190° F. 0.1 parts by weight of 1-(3-chloroallyl)-3,5,7-triaza-1-azoniaadamantane chloride, commercially available under the registered trademark of DOWICIL 75 from Dow Chemical Company was then added to deionized water and stirred at 190° F. until a clear, homogeneous solution was obtained. 0.75 parts by weight of 2-amino-2-methyl-1-proponal, commercially available under the registered trademark of AMP-95 from Angus Chemical Company, was then added to the deionized water mixture and stirred at 190° F. until a clear, homogeneous solution resulted.

With both vessel mixtures stabilized at 190° F. with moderate stirring, the deionized water-AMP-95-DOWICIL 75 solution from second vessel was added slowly in several portions into the vortex of the homogeneous mixture in the first vessel. Heat on both mixing vessels was then shut off. As the water mixture was added, a white, opaque emulsion was formed. After additional mixing for five minutes, 18.0 parts by weight of deionized water (which was at ambient temperature of 70° F.) was added directly into the vortex of the partially formed emulsion in the first mixing vessel. Emulsion was mixed with moderate stirring and cooled to 140° F. 0.50 parts by weight of an ethoxylated nonyl phenol, commercially available under the trademark of IGEPAL CTA-639W from G.A.F. Chemicals was then added into the vortex of the stirring emulsion. After ten minutes of mixing, final 10.0 parts by weight of deionized water (which was at ambient temperature of 70° F.) was added directly into the vortex of the stirring emulsion. Emulsion was then cooled with constant stirring to 100° F. The final product was a white, slightly viscous opaque emulsion having a uniform, homogeneous consistency. The product can be characterized as follows:

| | |
|---|---|
| Appearance: | White, opaque emulsion. |
| Odor: | Neutral |
| pH (as is): | 8.4–9.0 |
| Brookfield Viscosity: | 1000–3000 cps |
| Weight/Gallon (25° C.): | 8.25 |
| Refractive Index (25° C.): | 1.346–1.348 |

The chemicals used to prepare the water-based, solid dry film, high temperature prelube emulsion for hot roll steel composition of Example 1 are further characterized below:

The hydrogenated castor ester, the triglyceride of 12-hydroxy stearic acid, has an acid value of 2.2, saponification number of 180, an iodine value of 2.2 and a melting point of 186°–191° F. The tridecyl stearate has an acid value of 1.5, a saponification number from a minimum of 117 to 126 maximum, an iodine value of 0.5 and a specific gravity of 0.86. The hindered phenol antioxidant, 2,6-di-t-butyl-p-cresol, is a white crystalline powder with a melt point of 145°–149° F. The ethylene-acrylic acid copolymer was one having an acid number of about 120 (mg KOH/g), viscosity of 610 centipoise at 285° F. with a hardness of 11.5 (dmm at 25° C.) and a melting point of 92° C. (198° F.). The oleyl oxazoline was one having a specific gravity of 0.93 at 77° F., viscosity of 155 centipoise at 77° F. and a surface tension of 40 dynes per centimeter for 0.001% aqueous solution.

The double pressed stearic acid has a molecular weight of 285, an acid value of approximately 210 with an accompanying saponification value of 211, iodine value of 6.0 and a titer value ranging from a minimum of 119° F. to maximum of 121° F. The amino-methyl-proponal has a specific gravity of 0.942 at 77° F., viscosity of 147 centipoise at 77° F. and a neutralization value ranging from a minimum of 93 to a maximum of 97. The 1-(3-chloroallyl)-3,5,7-triaza-1-1 azoniaadamantane chloride is a dull white powder in appearance with a slight amine odor and a minimum activity level of 67.5%. The ethyloxylated nonyl phenol has a specific gravity of 1.06 at 77° F., molecular weight of 616 and a molecular formula of $(C_2H_4O)_9C_{15}H_{24}O$.

The solid film prelube emulsion composition prepared in Example 1 was coated onto various types of steel panels in laboratory by several different methods. Test panels are usually purchased from a major panel manufacturer such as Advanced Coating Technologies, Inc. (Hillsdale, Mich.). Test panels are usually 3"×6" or 4"×6" in size. Four specific test substrates are usually used:

1. General Motors cold rolled steel, 0.032" gauge of commercial quality SAE 1008 carbon steel. Hardness is B75-65 Rockwell with a surface finish of 25–40 micro inches. Panels are received as clean and bare.
2. General Motors 16-45E two side hot dip galvanized steel, 0.032" gauge cold rolled steel with a continuous (spangle free) zinc coating present on both sides. Zinc coating weight ranges from 0.6 to 1.0 ounce per square foot of surface area. Hardness is B60-45 Rockwell with an ultra smooth surface finish. Panels are received clean and bare.
3. General Motors 16-90E two side electrocoated galvanized steel, 0.031" gauge cold rolled steel with a continuous electrolytic zinc coating present on both sides. Zinc coating weight is 70 to 80 grams per square meter of surface area. Hardness is B60-45 Rockwell with an extra smooth finish. Panels are received clean and bare.
4. General Motors 16-3U hot roll steel, commercial quality, 0.071" gauge. Material is commercial quality of Rockwell hardness B5-75 and 0.15 maximum carbon. Panels are received clean and bare.

Before the coating process, all test panels are cleaned with hexane and xylene. When dry, the panel weight was recorded to 1/10,000 of a gram on a precise analytical scale, such a Mettler.

Specific coating weights can be achieved by using a variety of sizes of standard draw bars (sizes #2.5 - #20, available from Paul Gardner Co., Inc.) and various aqueous dilutions of the solid film prelube composition prepared in Example 1. Composition can be applied to steel test panels by one of two methods:

1. Method 1: Applying the lubricant composition (or dilution thereof) via a metal draw bar of a specific size. A uniform film was applied to test panel at ambient temperature and allowed to dry for sixty minutes at ambient temperatures to evaporate all water from the lubricant composition allowing the film to set. Coating panels are then placed on a warm hot plate with an accurate surface thermometer present. Panels are placed on the hot plate surface only momentarily, allowing for sufficient warming to 180° F. to liquify and reflow the dried lubricant composition. Panels are then allowed to cool to ambient temperature.
2. Method 2: Applying the lubricant composition (or dilution thereof) via a metal draw bar of a specific size. A uniform film was applied to a test panel whose surface was immediately, just prior to coating, warmed to 180° F. on a hot plate with an accurate surface thermometer present. Aqueous portion of the lubricant composition instantly evaporates and cools the coating, allowing it to set instantaneously. Panels are then allowed to cool to ambient temperature.

During the entire coating process, test panels are always handled by the preparer wearing disposable latex gloves to prevent surface contamination of the metal substrate. The coated panels are then reweighed again on the same scale and the solid film prelube film coating weight calculated and reported in milligrams per square foot. The coating methods described above are adequate only for small laboratory applications and preparations.

EXAMPLE 2

The solid film prelube emulsion composition prepared in Example 1 was tested to determine its forming and drawing characteristics on four steel substrates using the double draw bead simulator. 2"×12" test strips were coated as described in Method 2 of Example 2. Four test substrates used were the four listed in Example 2: cold rolled steel, hot dip galvanized, electrogalvanized and hot roll steel.

Solid film prelube composition was applied to an area of 2"×5" on both sides at one end of each strip. Test strips were aged 24 hours at ambient temperature prior to testing. Three test strips were produced for each lubricant of each steel substrate type. Average coating weights were 200±10 mg/ft$^2$. Test strips were then drawn through a pair of mated dies containing a series of three fixed draw bead surfaces in an A shape configuration. Strips were placed in fixed grips at one end with a grip pressurization of 3,000 psi. Strips were pulled a total distance of five inches through the dies at the rate of 100 inches per minute, a total downward force of 11,000 pounds exerted on the strips. An individual coefficient of friction is calculated for each coated strip followed by an average coefficient of friction for each set of three test strips for each lubricant and substrate combination. Two commercial dry film prelubes used on hot roll steel were also evaluated, soap-borax and acrylic polymer. In comparison, average coefficients of friction are listed below:

| | AVERAGE COEFFICIENT OF FRICTION | | | |
|---|---|---|---|---|
| LUBRICANT | COLD ROLLED STEEL | HOT DIP GALVANIZED | ELECTRO-GALVANIZED | HOT ROLL STEEL |
| Commercial Lubricant #1 | 0.0771 | 0.0867 | 0.0540 | 0.0793 |
| Soap-Borax | 0.1163 | 0.1097 | 0.1041 | 0.1176 |
| Acrylic Polymer | 0.1421 | 0.1248 | 0.1194 | 0.1463 |

The solid film prelube emulsion described in Example 1 provided better lubrication (based on lower average coefficients of friction) versus two commercial dry film prelubes on all four steel substrates evaluated.

EXAMPLE 3

The solid film prelube emulsion composition prepared in Example 1 above was evaluated to determine whether it would provide the necessary corrosion protection required for steel substrates during long periods of storage and transit in varying conditions of humidity and temperature. The Cleveland condensing humidity cabinet is one of an accelerated nature whereby exposure to the combined adverse conditions of temperature and humidity are increased thereby reducing the time factor for practical reasons.

Coatings were evaluated on 3"×6" test panels of the four steel substrates listed in Example 2: cold rolled steel, hot dip galvanized, electrogalvanized and hot roll steel. Panels were coated via Method 2 as described in Example 1. Coatings were applied to achieve a dry coating weight of 200±10 mg/ft$_2$ to one side of each test panel. Panels were then aged 24 hours at ambient temperature prior to testing.

The test chamber consisted of an atmosphere of condensing humidity at 100° F. and 100% relative humidity. Water vapor circulated continually in the chamber, condensing on the coated surfaces of test panels facing the internal chamber of the test cabinet. Water vapor condensed on the coated surfaces of the panels continually washing the panel surfaces. Panels were always handled while wearing disposable latex gloves to prevent surface contamination on the coatings from salts and oils commonly found on human skin. Panels were examined every 24 hours and the test concluded when rust, corrosion or staining appeared over more than five percent of panel surface. Coated panels were placed at fifteen degree angle of decline (from vertical) on the chamber.

For comparison, as in Example 2, two commercial dry film prelubes (soap-borax and acrylic polymer) were also run. Results are summarized below:

| | CORROSION: TIMES TO FAILURE | | | |
|---|---|---|---|---|
| LUBRICANT | COLD ROLLED STEEL | HOT DIP GALVANIZED | ELECTRO-GALVANIZED | HOT ROLL STEEL |
| Commercial Lubricant #1 | 9 Days | 6 Days | 9 Days | 45 Days |
| Soap-Borax | 4 Hours | 4 Hours | 10 Hours | 5 Hours |
| Acrylic Polymer | 8 Days | 1 Day | 1 Day | 6 Days |

The solid film prelube emulsion described in Example 1 provided excellent corrosion protection under the conditions of temperature and humidity tested on all four substrates evaluated versus two commercial dry film prelubes.

In addition, Phase I corrosion testing for automotive applications have been run and confirmed by independent laboratory testing. These tests are corrosion specifications determined by both Ford Motor Company and General Motors for automotive approval. Tests and results for hot roll steel are summarized below:

A. Ford Specification M-14B90A-B(F) consists of a consecutive 72 hour exposure cycle on Cleveland condensing humidity cabinet at 100° F. and 100% relative humidity. Solid film prelube emulsion described in Example 1 was tested at coating weight of 300 mg/ft$^2$ versus control oil specified at 800–900 mg/ft$^2$. In addition, two commercial dry film prelubes (soap-borax and acrylic polymer) were also run at 300 mg/ft$^2$. Results were:

| LUBRICANT | DEGREE OF CORROSION |
|---|---|
| Commercial Lubricant #1 | None |
| Control Mill Oil | 5% Rust |
| Soap-Borax | 100% Rust |
| Acrylic Polymer | None |

The solid film prelube emulsion described in Example 1 provided equivalent or better corrosion protection on hot roll steel versus control mill oil and two commercial dry film prelubes and would thus meet Ford requirements.

B. General Motors Specification 52–29 consists of a ten cycle corrosion test, each cycle consisting of eight hours exposure at ambient temperature and sixteen hours exposure in the humidity cabinet at 95° F. and 100% relative humidity. Solid film prelube emulsion described in Example 1 was tested at coating weight of 300 mg/ft$^2$ versus control oil specified at 800–900 mg/ft$^2$. In addition, two commercial dry film prelubes (soap-borax and acrylic polymer) were also run at 300 mg/ft$^2$. Ten cycles run were consecutive. Results were:

| LUBRICANT | DEGREE OF CORROSION |
|---|---|
| Commercial Lubricant #1 | None |
| Control Mill Oil | 10% Rust |
| Soap-Borax | 100% Rust |
| Acrylic Polymer | 15% Rust |

The solid film prelube emulsion described in Example 1 provided better corrosion protection on hot roll steel versus control mill oil and two commercial dry film prelubes and would thus meet General Motors requirements.

EXAMPLE 4

The solid film prelube emulsion composition prepared in Example 1 above was evaluated in a second series of corrosion evaluations to determine whether it would provide the necessary corrosion protection required for hot roll steel substrates exposed for long periods of time (transit and storage) to varying conditions of temperature and humidity. Corrosion tests in standard humidity cabinet were run on coated hot roll steel blanks used for compressor housings which had been coated with the composition prepared in Example 1 at an Eastern hot roll steel coating facility. Composition had been applied via the commercial method described in Example 2 at a final coating weight of 250–300 mg/ft$^2$.

The test chamber consisted of an enclosed chamber where moisture at 100° F. (heated deionized water) was misted into the chamber maintaining a relative humidity of 100%. Blanks were always handled while wearing disposable latex gloves to prevent surface contamination on the coatings from manual handling. Blanks were supported within the chamber in wooden racks in upright position at 45 degree angle. Blanks were circular in shape and approximately twenty-two inches in diameter. After ninety days consecutive exposure in the cabinet, less than one percent rust was present on the blanks and only in areas where the coating had been scratched and bare metal exposed. The corrosion was isolated to those bare areas and did not penetrate into the surrounding coating. The composition remained firm and homogeneous and showed no signs of softening or water absorption.

The solid film prelube emulsion described in Example 1 provided excellent corrosion protection for hot roll steel substrate stored under severe storage conditions of temperature and humidity.

EXAMPLE 5

Hot roll steel coils or blanks can often be stored for long periods of time under field conditions near pickling baths or cleaner lines containing aqueous solutions which incorporate acidic components such as hydrochloric or sulfuric acid. These solutions can be the source of atmospheric acid fumes that can severely stain or corrode the steel. For this reason, the solid film prelube emulsion composition prepared in Example 1 was tested to determine its effectiveness in protecting hot roll steel substrates from staining upon exposure to hydrochloric acid fumes.

A controlled atmosphere test chamber was used as described in Ford Motor Company acid atmosphere test, Ford procedure M-14B90A-B(F). Plexiglass test chamber was charged with separate solutions of deionized water and a dilute hydrochloric acid aqueous mixture which produced a 25 ppm acid vapor in the test chamber upon rotation of a plexiglass paddle within the chamber. The paddle was driven by a small gear motor. 50 mls. of dilute hydrochloric acid solution were placed in a central beaker surrounded by 200 mls. of deionized water in the chamber bottom. Test panels were suspended vertically into the test chamber through slots in the plexiglass lid.

Prior to coating, the 3"×4.5" hot roll steel panels described in Example 2 were cleaned by washing in hexane and air dried. Solid film prelube emulsion composition described in Example 1 was applied to achieve a dry coating weight of 300±10 mg/ft$^2$ as described in Method 2 as described in Example 2. Coated panels were aged for 24 hours at ambient conditions prior to testing. Panels were always handled while wearing disposable latex gloves to prevent surface coating contamination. The acid fume test chamber was run for thirty minutes prior to panel insertion to allow the acid atmosphere within the chamber to equilibrate at 25 ppm acid vapor concentration.

Coated panels were then inserted into the chamber and exposed for sixteen consecutive hours. For comparative purposes, two commercial dry film prelubes were run, soap-borax and acrylic polymer. Results are presented below for panels exposed sixteen hours. Panels were removed and examined visually for the percentage of surface area stained or corroded. Results were:

| LUBRICANT | DEGREE OF STAIN |
|---|---|
| Commercial Lubricant #1 | No stain |
| Soap-Borax | 100% Stain |
| Acrylic Polymer | 100% Stain |

The solid film prelube emulsion composition described in Example 1 provided excellent acid fume corrosion protection on hot roll steel versus two commercial dry film prelubes.

EXAMPLE 6

Cleanability, defined as the total removal of a solid film prelube coating, is extremely important. After metal parts are formed, the parts may be transferred to a variety of future processing operations including welding, bonding via use of structural adhesives or the deposition of a wide range of coatings including phosphate coatings and electrically applied primers and top coats.

For this reason, the solid film prelube emulsion composition described in Example 1 was tested for its removability via standard aqueous alkaline cleaners (at their recommended operating parameters) that are used in the U.S. automotive industry. Cleanability tests were run in a power spray wash unit, a self-enclosed system where alkaline cleaner solution is recirculated in a closed loop system. Cleaner solution is continuously heated in line and is applied to test panels hanging within the test chamber over a range of application pressures from five to thirty-five psi. Solid film prelube emulsion composition described in Example 1 was applied to test panels (4"×6") of four substrates described in Example 1 via laboratory coating Method 2 described in Example 1. The four test substrates were cold rolled steel, hot dip galvanized, electrogalvanized and hot roll steel. Coating was applied to one side of the test panels to achieve a dry coating weight of 150±10 mg/ft$^2$. For comparative purposes, two commercial dry film prelubes (soap-borax) and acrylic polymer) were also run. Two cleaning schemes were used, using powdered alkaline cleaners produced by Parker-Amchem. Two regiments are described below:

1. Parco 1500C run at a concentration of two ounces per gallon at temperature of 110°±1° F. Panels were exposed for two minutes to a spray solution applied at 20 psi.
2. Parco 2331 run at a concentration of one ounce per gallon at temperatures of 120°, 130° and 140° F. Panels were exposed for one minute to a spray solution applied at 20 psi. Temperature variance for all three application temperatures was plus or minus one degree.

Following both cleaning schemes, panels were rinsed for thirty seconds in a deionized water rinse spray applied at 20 psi. Panels were then fully immersed in a saturated aqueous copper sulfate solution (slightly acidic) which deposits a uniform copper coating on all cleaned areas. This presents an excellent visual record of the degree of cleanability. Results are presented below:

| TEMPERATURE/ CLEANER | DEGREE OF CLEANABILITY | | | |
|---|---|---|---|---|
| | COLD ROLLED STEEL | HOT DIP GALVANIZED | ELECTRO-GALVANIZED | HOT ROLL STEEL |
| | COMMERCIAL LUBRICANT #1 | | | |
| 1500° C./110° F. | 100% Clean | 100% Clean | 100% Clean | 100% Clean |
| 2331/120° F. | 100% Clean | 100% Clean | 100% Clean | 100% Clean |
| 2331/130° F. | 100% Clean | 100% Clean | 100% Clean | 100% Clean |
| 2331/140° F. | 100% Clean | 100% Clean | 100% Clean | 100% Clean |
| | SOAP-BORAX | | | |
| 1500° C./110° F. | 100% Clean | 100% Clean | 100% Clean | 100% Clean |
| 2331/120° F. | 100% Clean | 100% Clean | 100% Clean | 100% Clean |
| 2331/130° F. | 100% Clean | 100% Clean | 100% Clean | 100% Clean |
| 2331/140° F. | 100% Clean | 100% Clean | 100% Clean | 100% Clean |
| | ACRYLIC POLYMER | | | |
| 1500° C./110° F. | 50% Clean | 40% Clean | 30% Clean | 50% Clean |
| 2331/120° F. | 25% Clean | 20% Clean | 20% Clean | 40% Clean |
| 2331/130° F. | 25% Clean | 20% Clean | 20% Clean | 40% Clean |
| 2331/140° F. | 50% Clean | 50% Clean | 40% Clean | 50% Clean |

The solid film prelube emulsion composition described in Example 1 was easily removed on all test substrates with both alkaline cleaners at their recommended operating conditions and offered equivalent or better cleanability to the two commercial dry film prelubes.

EXAMPLE 7

After metallic parts are formed, trace amounts of the lubricant coating will enter the plant waste treatment process either concentrated (removed via skimming or centrifuging from the alkaline cleaner stream) or diluted in the entire alkaline cleaner stream when portions of or the entire stream is dumped. The lubricant coating cannot interfere in any way with the overall treatment process nor any of the individual treatment chemicals used in the process. The lubricant composition cannot interfere or react with any of the waste stream components. The solid film prelube composition described in Example 1 was evaluated in a standard laboratory emulsion test for waste treatability. A standard alkaline cleaner form Parker-Amchem, Parco 348 at concentration of three percent in deionized water was used as the alkaline cleaner stream. Cleaner stream was warmed up to its standard and operating temperature of 140° F. and contaminated with the following:

A. Two percent by weight of lubricant composition described in Example 1 to simulate a low level of contamination.

B. Nine percent by weight of lubricant composition described in Example 1 to simulate a high level of contamination.

C. Nine percent by weight of Quaker 61A-US mill oil (hydrocarbon oil base rust preventative) to simulate a high level of contamination, which is representative of the current oil base lubricants being used.

Cleaner stream solutions were injected into the A-IV standard emulsion at dosage levels of 5,000 and 10,000 ppm. Samples were run through the following waste treatment scheme: samples treated with the dosage level of aluminex (ppm) necessary to produce a clear solution followed by adjustment with sodium hydroxide to pH of eight. Samples were then treated with a standard cationic waste treatment polymer and the solids skimmed from the aqueous solution. C.O.D. values (chemical oxygen demand) in parts per million were then run on the clear water layers devoid of skimmed solids. Results are listed below (dosages of aluminex necessary to produce clear solutions and C.O.D. values for the clear water solutions resulting from treatment):

| SOLUTION | ALUMINEX LEVEL | C.O.D. |
|---|---|---|
| A. Standard | 1500 | 960 |
| B. 3% Parker 348 | | |
| 5,000 ppm | 1800 | 1000 |
| 10,000 ppm | 2200 | 990 |
| C. 3% Parker 348 plus 2% Nalco Lubricant #1 | | |
| 5,000 ppm | 1800 | 1000 |
| 10,000 ppm | 2100 | 1000 |
| D. 3% Parker 348 plus 9% Nalco Lubricant #1 | | |
| 5,000 ppm | 1900 | 990 |
| 10,000 ppm | 2200 | 1100 |
| E. 3% Parker 348 plus 9% Quaker 61A-US | | |
| 5,000 ppm | 1800 | 1000 |
| 10,000 ppm | 2200 | 1000 |

As can be seen, the solid film prelube composition described in Example 1 had no negative impact on treatment product dosage levels or on effluent C.O.D. values over the wide range of contamination values. There were no differences between solid film prelube composition and the Quaker 61A-US mill oil. The lubricant composition described in Example 1 was totally removed from the treatment stream with the standard waste treatment chemicals over the wide range of contamination levels. The lubricant composition described in Example 1 will have no effects on standard waste treatment processes and itself will be easy to waste treat.

EXAMPLE 8

S.E.M. photos (scanning electron microscope) of solid film lubricant coatings have been found to be useful in interpreting structural and functional characteristics of the coating such as film morphology, uniformity and coverage rates on the metal substrate. Photos were taken of coatings on hot roll steel at magnifications of both 100X and 500X in both sectional and backscatter modes of the solid film prelube emulsion composition described in Example 1 and for comparative purposes, two commercial dry film prelubes: soap-borax and acrylic polymer. The morphology and appearance of a solid film prelube coating on a hot roll steel substrate (presence of layers, gaps or striations in the coating, the absence/presence of layers, absence/presence of pores or craters and surface contours) play a key role in the performance parameters of that coating, especially in the crucial areas of lubrication, corrosion protection and cleanability. Photos reveal the bare hot roll steel substrate to be very uniform and homogeneous. The surface is essentially flat with a pebbled, reticulate composition in form and nature. The reticulate nature lacks any defined peaks or valleys, and the surface granular features are uniform in size, shape and orientation. The soap-borax film appears to lack any uniformity and consistency. Large areas of metal substrate are exposed indicating film coverage is poor. Film itself contains a large number of pores, which vary in size and distribution. Acrylic polymer film appears more uniform with good surface coverage but a large number of peaks and valleys are present. Cracks and pores appear frequently and randomly throughout the coating.

The solid film prelube emulsion composition described in Example 1 to be essentially flat, closely following surface contours of the hot roll substrate. Coating structure is uniform and homogeneous. The coating structurally is composed of several layers of overlapping platelets, which are uniform in size though shapes trend from round to oval. No gaps, pores or cracks were visible in the coating and no defined hills or valleys were present. Coverage on the substrate was complete (100%), with the surface devoid of any bare spots.

The composition described in Example 1 appears more uniform and homogeneous than commercial dry film prelubes with regards to coating structure and coverage. This uniformity accounts for the desirable performance properties exhibited in all areas over the competitive products.

Having thus described my invention, I claim:

1. A solid film prelube emulsion comprising a fatty acid triglyceride-in-water emulsion having the following formula:

| Ingredients | % by weight |
|---|---|
| A. $C_{14}$–$C_{22}$ fatty acid triglyceride | 5.0–10.0 |
| B. Water-in-oil emulsifier having an HLB number of at least 8. | 3.0–8.0 |
| C. Deionized Water | 65.0–85.0 |

2. The solid film prelube emulsion of claim 1 where A is the triglyceride of 12-hydroxystearic acid, B as in HLB number of from 8 to 18 and is present in an amount ranging from 3.0–5.0% by weight.

3. A solid film prelube emulsion comprising a fatty acid triglyceride-in-water emulsion having the following formula:

| Ingredients | % by weight |
|---|---|
| A. $C_{14}$–$C_{22}$ fatty acid triglyceride | 5.0–10.0 |
| B. Water-in-oil emulsifier having an HLB number of at least 8. | 3.0–8.0 |
| C. Deionized Water | 65.0–85.0 |
| D. Boundry lubricant and film plasticizer | 0.1–3.0 |
| E. Antioxidant | 0.1–2.0 |
| F. Ethylene polymer | 0.1–3.0 |
| G. Corrosion inhibitor | 1.0–5.0 |
| H. Microbiocide | 0.5–1.0 |
| I. High temperature surfactant | 0.1–2.0 |

4. The solid film prelube emulsion of claim 3 where A is the triglyceride of 12-hydroxystearic acid; B as in HLB number of from 8 to 18 and is present in an amount ranging from 3.0–5.0% by weight.

5. A method of lubricating metal comprising applying to the metal a coating of the lubricant of claim 1.

6. A method of lubricating of claim 5 where the coating weight ranges from 50 mg/ft$^2$–500 mg/ft$^2$.

7. A method of lubricating a metal comprising applying to the metal a coating of the lubricant of claim 3.

8. The method of lubricating of claim 7 where the coating weight ranges from 50 mg/ft$^2$–500 mg/ft$^2$.

* * * * *